US010337449B2

(12) United States Patent
Hopf et al.

(10) Patent No.: US 10,337,449 B2
(45) Date of Patent: Jul. 2, 2019

(54) INTERNAL COMBUSTION ENGINE WITH CYLINDER HEAD

(71) Applicant: Ford Global Technologies, LLC, Dearborn, MI (US)

(72) Inventors: Anselm Hopf, Baesweiler (DE); Guenter Bartsch, Gummersbach (DE); Stefan Quiring, Leverkusen (DE); Florian Huth, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/853,520

(22) Filed: Dec. 22, 2017

(65) Prior Publication Data

US 2018/0187625 A1 Jul. 5, 2018

(30) Foreign Application Priority Data

Jan. 2, 2017 (DE) ..... 10 2017 200 001
Jan. 2, 2017 (DE) ..... 10 2017 200 002

(51) Int. Cl.
*F02F 1/42* (2006.01)
*F02F 1/24* (2006.01)

(52) U.S. Cl.
CPC ..... *F02F 1/243* (2013.01); *F02F 1/42* (2013.01); *F02F 1/4264* (2013.01)

(58) Field of Classification Search
CPC . F02F 1/4264; F02F 2001/4278; F01N 13/10; F01N 13/08
See application file for complete search history.

(56) References Cited

U.S. PATENT DOCUMENTS

| | | | | |
|---|---|---|---|---|
| 2,578,932 | A | 12/1951 | Hinze et al. | |
| 4,228,653 | A | 10/1980 | Sperry | |
| 5,406,795 | A | 4/1995 | Raub et al. | |
| 5,689,954 | A * | 11/1997 | Blocker | F01N 13/10 138/155 |
| 5,706,655 | A * | 1/1998 | Kojima | F01N 13/102 60/322 |
| 5,816,210 | A | 10/1998 | Yamaguchi | |
| 6,082,104 | A * | 7/2000 | Hyakutake | F01N 13/10 29/890.08 |
| 6,324,838 | B1 * | 12/2001 | Stempien | F01N 3/2892 60/323 |
| 6,892,532 | B2 | 5/2005 | Bruce et al. | |
| 7,270,091 | B2 | 9/2007 | Matsui et al. | |
| 2005/0115231 | A1 * | 6/2005 | Ashida | F01N 13/10 60/313 |

(Continued)

FOREIGN PATENT DOCUMENTS

| | | | |
|---|---|---|---|
| FR | 2929653 | A1 | 10/2009 |
| JP | 2013133787 | A | 7/2013 |

(Continued)

*Primary Examiner* — Long T Tran
(74) *Attorney, Agent, or Firm* — Julia Voutyras; McCoy Russell LLP

(57) ABSTRACT

Systems are provided for exhaust gas passages in integrated and conventional exhaust manifolds. In one example, a system may include an exhaust gas passage that has a cross section which features curved limb shapes. This passage may also feature other shapes of cross sections at other points along the passage.

20 Claims, 7 Drawing Sheets

(56) References Cited

U.S. PATENT DOCUMENTS

| | | | | |
|---|---|---|---|---|
| 2006/0032219 | A1* | 2/2006 | Dirker | F01N 13/10 60/323 |
| 2008/0302095 | A1* | 12/2008 | Ruehle | F01N 13/10 60/323 |
| 2009/0223476 | A1* | 9/2009 | Shinkai | F02M 26/12 123/184.21 |
| 2010/0229540 | A1* | 9/2010 | Waggoner | F01N 3/046 60/298 |
| 2011/0132296 | A1 | 6/2011 | Kuhlbach | |
| 2012/0023902 | A1 | 2/2012 | Ackerschott et al. | |
| 2012/0042649 | A1* | 2/2012 | Kaneko | F01L 1/08 60/614 |
| 2015/0167583 | A1* | 6/2015 | Sakamoto | F01N 13/001 60/323 |

FOREIGN PATENT DOCUMENTS

| | | | |
|---|---|---|---|
| JP | 2014125901 | A | 7/2014 |
| JP | 2016056756 | A | 4/2016 |

* cited by examiner

INTERNAL COMBUSTION ENGINE WITH CYLINDER HEAD

CROSS REFERENCE TO RELATED APPLICATION

The present application claims priority to German Patent Application No. 102017200002.3, filed on Jan. 2, 2017, and to German Patent Application No. 102017200001.5, filed on Jan. 2, 2017. The entire contents of the above-referenced applications are hereby incorporated by reference in their entirety for all purposes.

FIELD

The present description relates generally to exhaust manifolds and integrated exhaust manifolds.

BACKGROUND/SUMMARY

Internal combustion engines have at least one cylinder head which is connected to the cylinder block to form a cylinder. The cylinder head and block also include bores for receiving connecting elements. To accommodate the pistons or the cylinder liners, the cylinder block has a corresponding number of cylinder bores, in which the pistons are guided in an axially movable fashion. The cylinder head conventionally serves to hold the valve drives. To control the charge exchange, an engine requires control elements and actuating devices for actuating the control elements. During the charge exchange, the combustion gases are discharged via at least one outlet opening and the charging of the combustion chamber takes place via at least one inlet opening of the cylinder. Engines often make use of lifting valves as the control elements to control the charge exchange. Lifting valves perform an oscillating lifting movement during the operation of the engine which open and close the inlet and outlet opening. The valve actuating mechanism required for the movement of a valve is referred to as the valve drive. A valve actuating device generally comprises a camshaft mounted on the cylinder head. Valve drives open and close the inlet and outlet openings of a cylinder at the correct times. A fast opening and large flow cross sections are advantageous to keep the throttling losses in the inflowing and outflowing gas flows low, to ensure the best possible charging of the cylinder and an effective complete discharge of the combustion gases.

During the discharge of the exhaust gases into the exhaust-gas discharge system, a backflow of exhaust gas into the cylinders should be avoided. The evacuation of the combustion gases out of a cylinder of the engine during the charge exchange is based substantially on two different mechanisms. In one mechanism, the outlet valve opens when the piston is close to bottom dead center and the combustion gases flow at high speed through the outlet opening into the exhaust-gas discharge system. This high speed flow is due to the high pressure level prevailing in the cylinder toward the end of the combustion and the associated high pressure difference between combustion chamber and exhaust line. This flow process is assisted by a high pressure peak referred to as a pre-outlet shock. The pre-outlet shock propagates along the exhaust line at the speed of sound, with the pressure being dissipated with increasing distance traveled as a result of friction.

In the second mechanism of exhaust gas evacuation, the pressures in the cylinder and in the exhaust line are equalized. The combustion gases are no longer evacuated primarily in a pressure-driven manner but rather are expelled as a result of the stroke movement of the piston.

The pressure losses along the exhaust line, in the flow direction, increase with increasing distance traveled. Minimization of these pressure losses helps to achieve greater exhaust gas evacuation. The minimization of the pressure losses also helps to prevent backflow of exhaust gas from the exhaust passages into the cylinder. Another benefit of reducing pressure losses is providing higher energy exhaust gas to turbines in engines which make use of a turbocharger. Another advantage of improving the exhaust gas flow is that exhaust-gas aftertreatment systems reach their operating temperature or light-off temperature more quickly, which is particularly useful during cold start conditions.

Integrated exhaust manifolds may be used to reduce pressure losses and optimize the exhaust paths. In an integrated exhaust manifold, the exhaust lines of an engine are within the cylinder head. Cylinder heads with integrated exhaust manifolds feature compact design, which permits dense packaging of the drive unit as a whole. Furthermore, said exhaust manifold can benefit from a liquid-type cooling arrangement that may be provided in the cylinder head, such that the manifold does not need to be manufactured from high thermal load and expensive materials. These cylinder heads also reduce the number of components which reduces complexity, cost, and weight. Engines often include a plurality of coolant ducts or at least one coolant jacket is generally formed in the cylinder head. Cooling the exhaust gases provides several benefits. Reduced exhaust gas temperature protects downstream components such as sensors, catalytic converters, and turbines. One particular benefit of integrated exhaust manifolds with liquid cooling is the potential avoidance of increasing fuel usage to reduce high exhaust gas temperature to protect the turbocharger and the catalytic converter, especially for gasoline engines. This increased fuel usage is common practice and negatively affects fuel economy.

In one example, the issues described above may be addressed by an engine having a cylinder head and a cylinder, the cylinder having an outlet opening, the outlet opening being connected to an exhaust passage, the exhaust passage having a cross section which changes in a flow direction, and the cross section having a W-shaped outline at a location. In this way, flow from the cylinder may be optimized by reducing friction and pressure loss creating greater evacuation, reducing backflow, and greater flow energy.

As one example, an engine can be designed with exhaust lines with variable cross sectional shape along the length of the line. This shape can be designed to maximize the flow at various locations in the line. One such shape may be that of a W with curved edges. It has been found that a W-shaped cross section minimizes or reduces the pressure losses as a result of friction. Such an engine would see reduced frictional losses and backflow of exhaust gasses into the engine. Conventionally designed engines without optimally shaped exhaust lines would have greater frictional loss and backflow in comparison.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1 and 3-6 are shown approximately to scale.

DETAILED DESCRIPTION

The following description relates to engines featuring exhaust passages with cross sectional shapes which vary in the flow direction. These exhaust passages may be part of an integrated cylinder head and may also lead to a turbine. The cross sectional shape may take different forms and rotate along the length of the passage. The exhaust passage may also change direction relative to several axes. These features reduce frictional losses of the exhaust gas as it travels thought the passage and prevents back flow of the gas into the piston.

Embodiments of this invention may be produced by a variety of methods. Methods may include casting and additive manufacturing among others.

Figure 1:
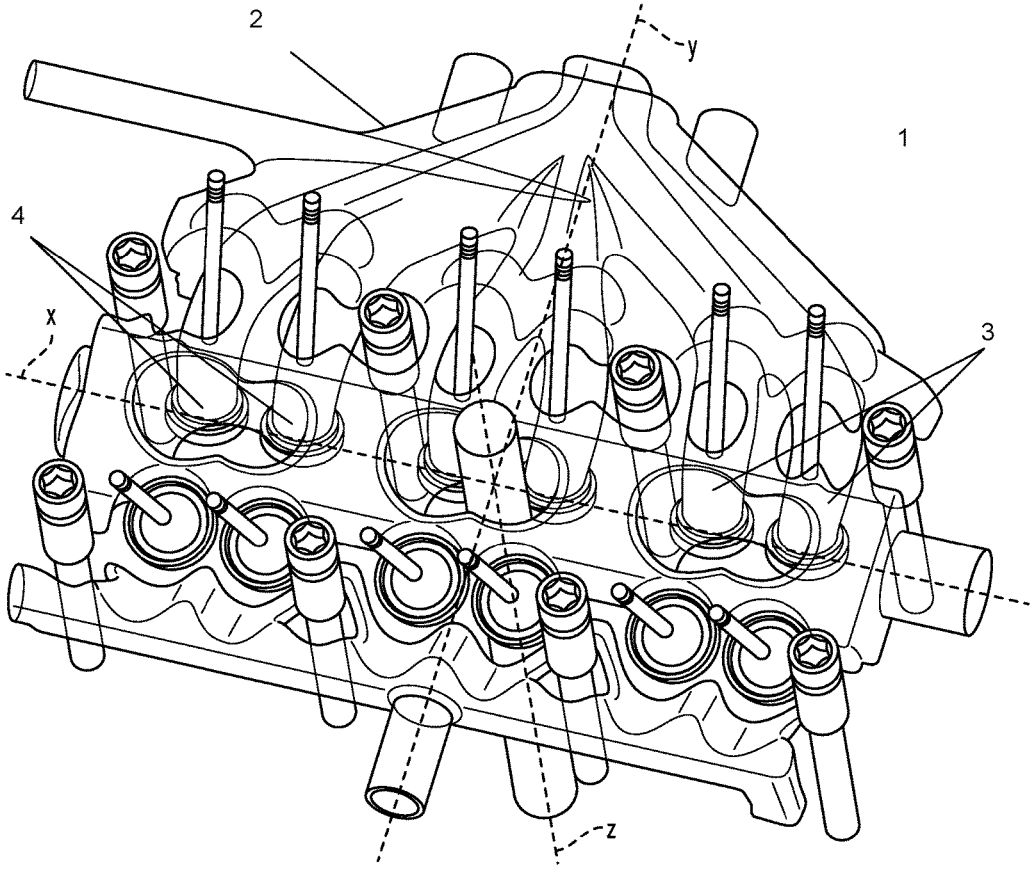
FIG. 1 is a top down view through a cylinder head of an engine with integrated exhaust manifold.

FIG. 1 depicts a top down view of an engine. FIG. 1 shows an engine 1 with integrated exhaust manifold 2. FIG. 1 also includes exhaust passages 3 and outlet openings 4. Exhaust gas exits the cylinder through the outlet openings 4. FIG. 1 also depicts the axes that will be used for reference in the present Application. The z-axis is oriented longitudinally with the cylinder. The x-axis is oriented perpendicular to the z-axis and extends through the cylinders in multi-cylinder engines. The y-axis is perpendicular to both the x-axis and z-axis and extends away from the cylinder bank in multi-cylinder engines.

Embodiments feature exhaust lines of an engine that merge within the cylinder head, so as to form an integrated exhaust manifold. If the exhaust lines merge within the cylinder head, so as to form an integrated exhaust manifold, the cross sections according to the Application are inevitably arranged within a cylinder head. Other embodiments may also feature conventional exhaust manifolds with exhaust line cross sections according to the invention outside of the cylinder head. These embodiments may feature at least two exhaust lines merging to form an overall exhaust line outside the at least one cylinder head.

Embodiments may also feature direction injection. Direct injection is a concept for dethrottling an engine, in the case of which the load control is realized by means of quantity regulation. The injection of fuel directly into the combustion chamber of the cylinder is to be considered to be a suitable measure for noticeably reducing fuel consumption. With the direct injection of the fuel into the combustion chamber, it is possible to create a stratified combustion chamber charge. This stratified charge can contribute significantly to the dethrottling of the Otto-cycle working process because the engine can be leaned to an extent by means of the stratified charge operation. The stratified charge offers thermodynamic advantages in particular in under light loads when only small amounts of fuel are to be injected. Embodiments of the engine include each cylinder being equipped with an injection device for the direct injection of fuel into the cylinder.

Figure 2:
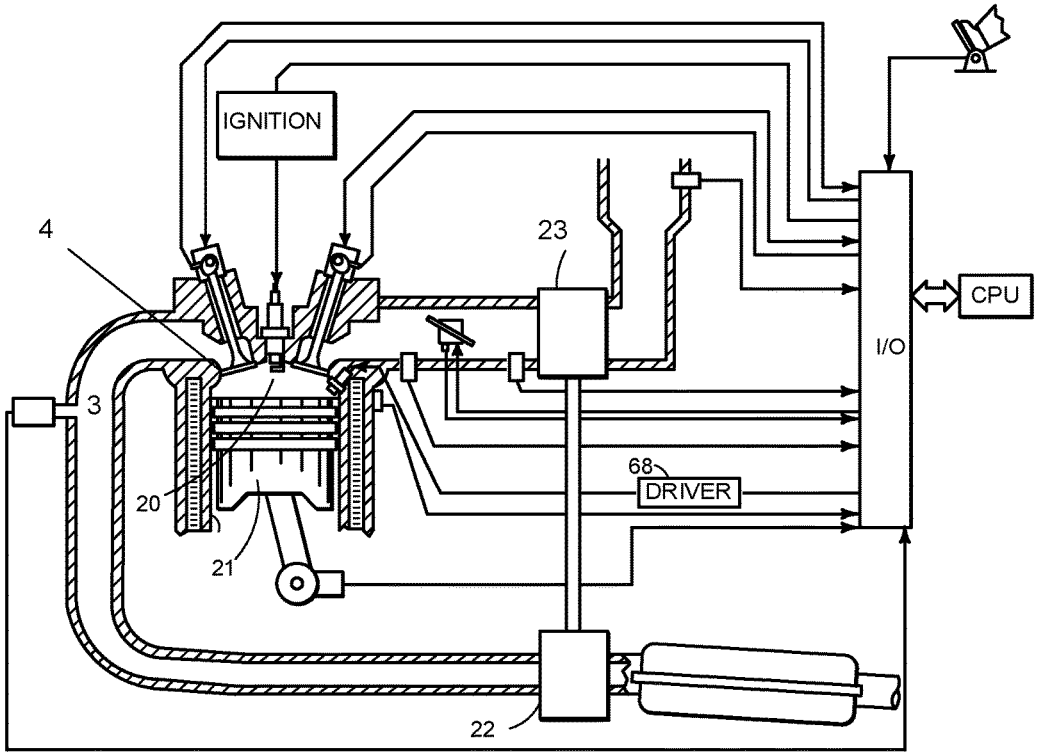
FIG. 2 is a schematic view of an engine featuring a turbocharger.

FIG. 2 is a schematic view of an engine system. FIG. 2 depicts a cylinder 20 with a piston 21. Exhaust gas exits the cylinder 20 through outlet openings 4 and travels through exit passages 3. The exhaust passage 3 is connected to a turbine 22. The turbine 22 is connected to compressor 23 which charges air.

Supercharging is a suitable means for increasing the power of an internal combustion engine while maintaining an unchanged swept volume, or for reducing the swept volume while maintaining the same power. Supercharging leads to an increase in volumetric power output and a more expedient power-to-weight ratio. If the swept volume is reduced, it is possible to shift the load collective toward higher loads, at which the specific fuel consumption is lower. Supercharging of an internal combustion engine consequently assists in the efforts to minimize fuel consumption and improve the efficiency of the internal combustion engine. Embodiments of an engine are advantageous in which a supercharging arrangement is provided. Some embodiments may specifically include an engine in which at least one exhaust-gas turbocharger is provided which comprises a turbine arranged in the exhaust-gas discharge system and a compressor arranged in the intake system.

With targeted configuration of the supercharging, it is also possible to obtain advantages with regard to exhaust-gas emissions. An example is a diesel engine with suitable supercharging can achieve lower nitrogen oxide emissions without any losses in efficiency. At the same time, the hydrocarbon emissions can be positively influenced. The emissions of carbon dioxide, which correlate directly with fuel consumption, likewise decrease with falling fuel consumption.

For supercharging, use is often made of an exhaust-gas turbocharger, in which a compressor and a turbine are arranged on the same shaft. The hot exhaust-gas flow is fed to the turbine where it releases energy and rotates the shaft. The energy released by the exhaust-gas flow to the turbine and ultimately to the shaft is used for driving the compressor which is likewise arranged on the shaft. The compressor conveys and compresses the charge air fed to it, as a result of which supercharging of the cylinders is obtained. A charge-air cooler may be provided in the intake system downstream of the compressor where air is cooled before it enters the cylinders. Then charge-air cooler lowers the temperature and thereby increases the density of the charge air, such that the cooler also contributes to improved charging of the cylinders and greater air mass flow. Compression by cooling takes place.

Figure 3:
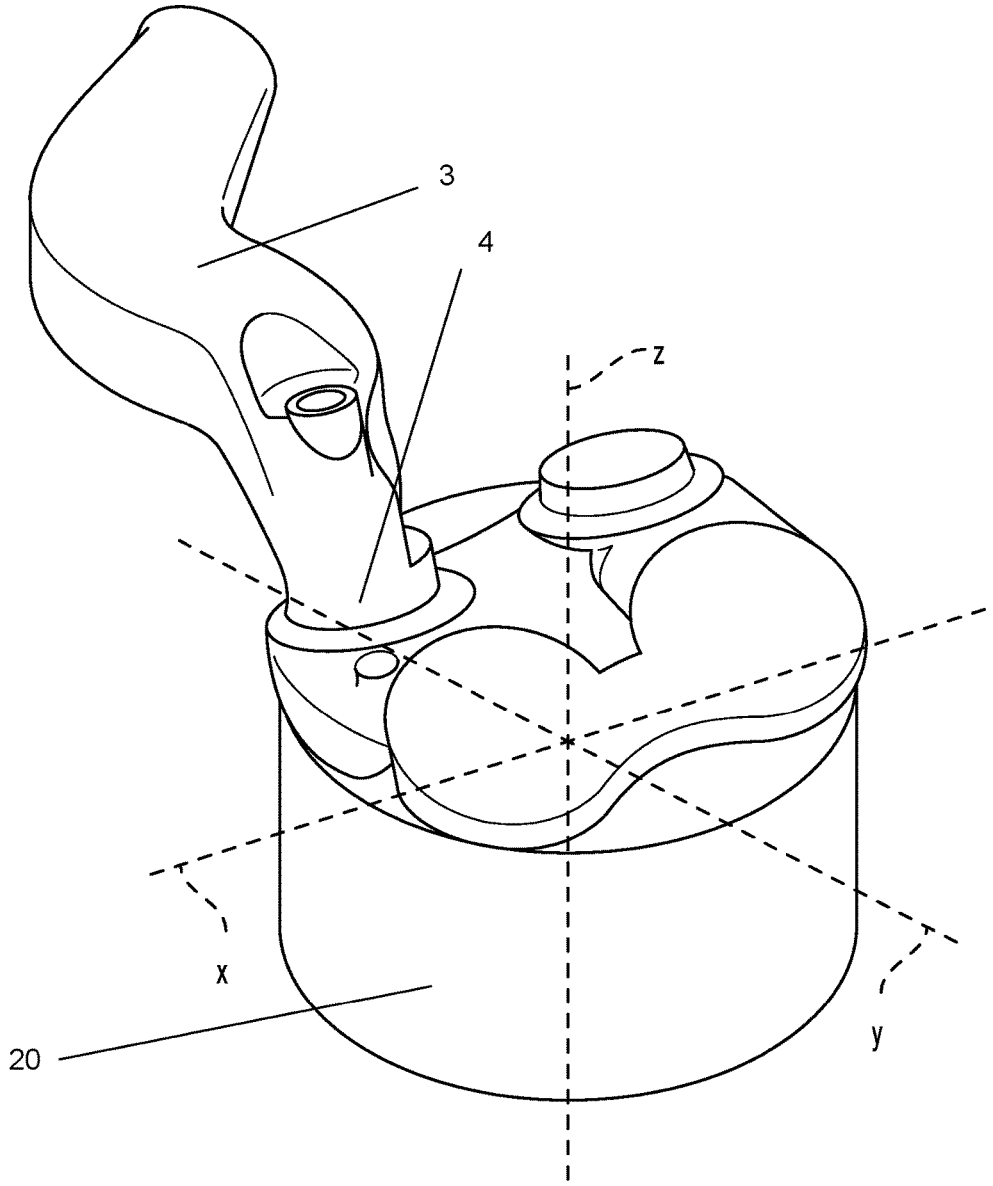
FIG. 3 is a view of a cylinder and exhaust passage.

FIG. 3 shows cylinder 20 and exhaust passage 3. Exhaust gas travels through the outlet opening 4 into exhaust passage 3. The axis system described in FIG. 1 is also shown in FIG. 3. FIG. 3 shows an exhaust passage that changes direction relative to all three axes. FIG. 3 depicts a configuration wherein the gas traveling through the passage would initially be traveling in a primarily z direction before bending to travel in a primarily y direction. A further bend would direct the gas into a direction defined by both x and y. This configuration is only one embodiment of the Application. Other embodiments could include shapes with shorter traveling distances, less z direction travel, smoother curves, and many other configurations.

Figure 4:
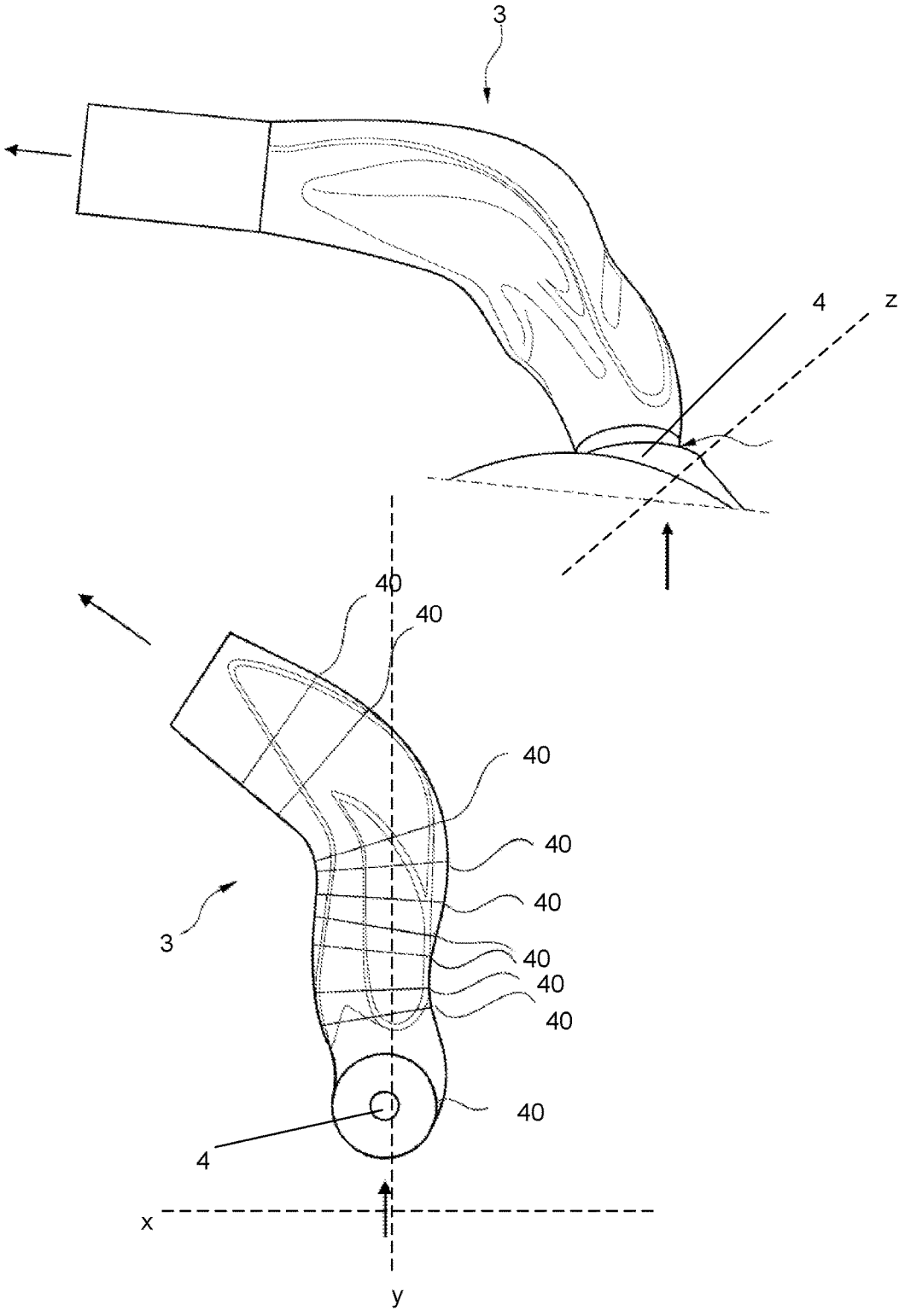
FIG. 4 shows is a three-dimensional illustration of an exhaust passage.

FIG. 4 shows another embodiment of an exhaust passage configuration. As can be seen, the exhaust passage include a smooth curving shape and also contains a concave curvature. The exhaust passage changes direction relative to all 3 axes. The z axis is not pictured and would extend into the page perpendicular to the other 2 axes. The exhaust passage 3 is connected to the outlet opening 4 of a cylinder of the engine and serves for the discharge of exhaust gas from the cylinder. The flow direction of the exhaust gas is indicated by an arrow at the inlet into the exhaust passage 3 and at the outlet opening 4. Proceeding from the outlet opening 4 of the cylinder, the exhaust passage 3 changes its cross section in the flow direction. FIG. 4 also illustrates the changing cross section of exhaust passage 3. The FIG. 4 shows various cross sections 40 which in this embodiment would all have different shapes. Other embodiments may include sections of the passage that have substantially similar shapes but differ from other sections of the passage. In one embodiment, one of the cross sections 40 has a W-shaped outline at a point in exhaust passage 3.

Figure 5A:
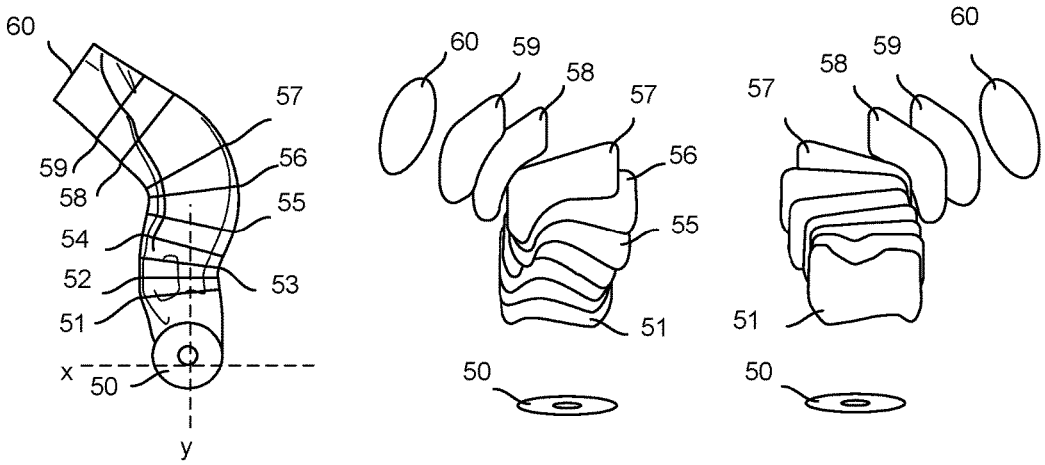
FIG. 5A shows exhaust passages and various cross sections of the exhaust passages.
Figure 5B:
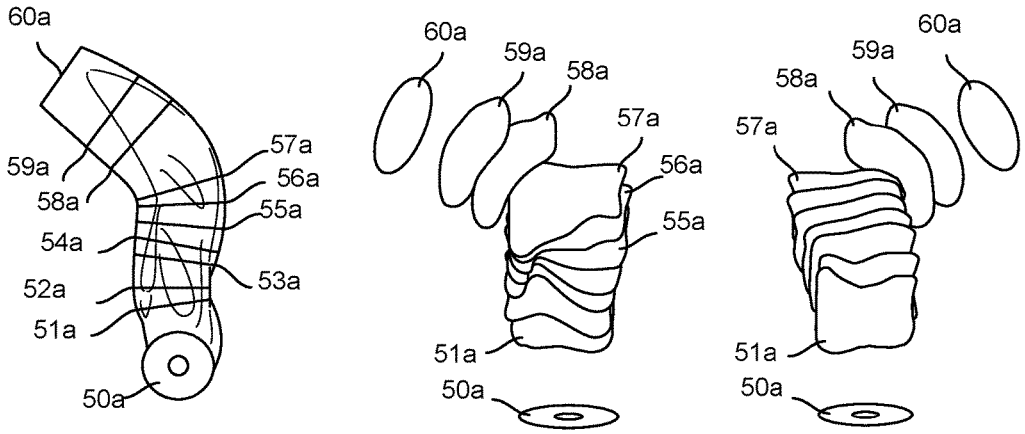
FIG. 5B shows exhaust passages and various cross sections of the exhaust passages.

FIG. 5A shows a further embodiment of exhaust passages. FIG. 5A shows an exhaust passage with cross sections 50-60. The embodiment depicted in FIG. 5A shows an exhaust passage bending in relation to all the axes. The z axis is not pictured and would extend into the page perpendicular to the other 2 axes. It also shows a passage with a smooth curving profile. Furthermore, it can be seen that each of cross section 50-60 has a different shape. FIG. 5B shows an exhaust passage of a similar embodiment to FIG. 5A. However, FIG. 5B depicts an embodiment with different cross section shapes than that of FIG. 5A. These cross section shapes can be seen as cross sections 50*a*-60*a*. FIGS. 5A and 5B are representative of the various embodiments that can be used to design an optimal flow path through an exhaust passage. These optimal flow paths with various bends and cross sections can be used to reduce frictional losses and backflow of exhaust gas into the cylinder.

Figure 6:
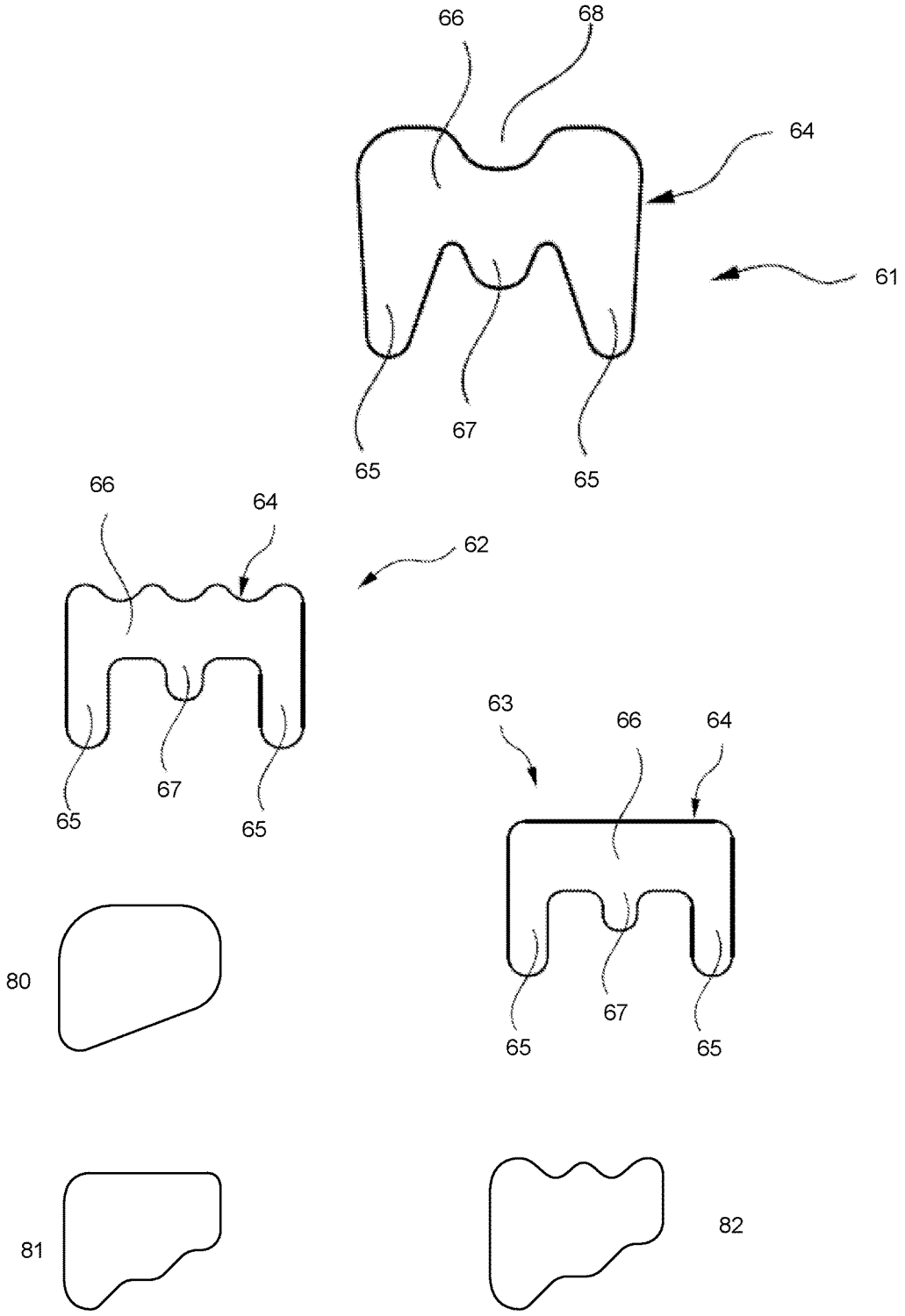
FIG. 6 shows various possible cross sections for an exhaust passage.

FIG. 6 shows potential embodiments of cross sections of exhaust passages. The cross section 61 has a rotated W-shaped outline, or is W-shaped in the present case. The substantially W-shaped cross section 61 is delimited by an edge 64 which runs in curving fashion and has rounded corners. The cross section 61 has two lateral limbs 65, which are connected to one another by an interposed central limb 66. A third limb 67 branches off from the central limb 66 and the third limb 67 is arranged between the two lateral limbs 65. The third limb 67 may also be shorter than each of the two lateral limbs 65. An edge 64 which delimits the central limb 66 at the outside has an inwardly directed depression 68 which is provided on the side situated opposite the third limb 67.

Cross section 62 shows a cross section of an exhaust passage of a further embodiment. Only the additional features in relation to the embodiment illustrated in cross section 61 will be discussed. By contrast to the cross section 61, the edge 64 which delimits the central limb 66 at the outside runs in undulating fashion.

Cross Section 63 shows a cross section of another embodiment of an exhaust passage. By contrast to the cross section 61, the edge 64 which delimits the central limb 66 at the outside has no inwardly directed depression. The third limb 67 which branches off from the central limb 66 is, as in cross section 61, shorter than each of the two lateral limbs 65.

FIG. 6 also depicts cross sections 80-82 which comprise further embodiments of cross sections of exhaust passages. Several combinations of shapes and features can be seen in cross sections 80-82. Cross section 80 features a trapezoid shape. By contrast to cross section 80, cross sections 81 and 82 feature undulating sections at one or more edges. Shape may also be symmetric or asymmetric. Many other combinations of shapes, curvatures and features may be used in order to optimize exhaust gas flow through the passage in order to reduce frictional loss and backflow into the cylinder.

Embodiments of the engine are advantageous in which the cross section has at least one rounded corner. It has proven to be advantageous from a flow aspect if the edge which delimits the cross section has no sharp-edged corners, but rather runs in curving fashion. For this reason, embodiments of engines include an edge which delimits the cross section runs in curving fashion.

Embodiments of the engine may be advantageous in which an edge which delimits the cross section runs in undulating fashion, wherein both a regular and an irregular undulating profile may be expedient. Therefore, some embodiments of engines include an edge which delimits a W-shaped cross section and runs in undulating fashion on opposite sides of the cross section.

Embodiments of engines are advantageous in which the cross section has two lateral limbs which are connected to one another by an interposed central limb. Other advantageous configurations include a third limb which branches off from the central limb. The third limb may also be arranged between the two lateral limbs. Further embodiments include configurations where the third limb is shorter than each of the two lateral limbs.

Cross sectional shapes that feature depressions have also been found to be advantageous. An example is a third limb branching from the central limb featuring a depression. Further embodiments include a depression that is directed inwardly and is provided on that side of the central limb which is situated opposite the third limb.

Figure 7:
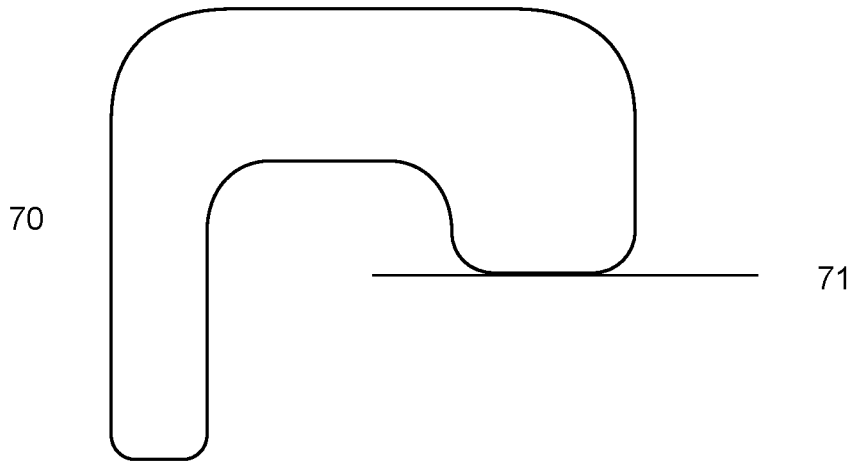
FIG. 7 shows a cross section with an angle of rotation.
Figure 7:
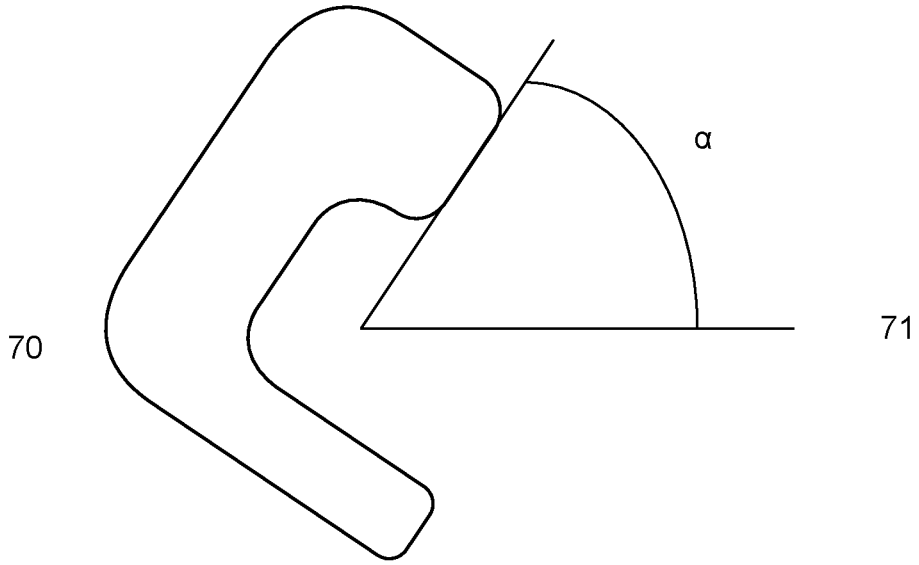

FIG. 7 depicts a possible rotation of a cross section 70. Cross section 70 rotates relative to an axis 71. Angle $\alpha$ depicts the rotation of the cross section 70 relative to axis 71. FIG. 7 shows the possible rotation of a cross sectional shape of an exhaust passage. The cross sectional shape may rotate relative to the flow direction of the exhaust gas as it travels through the passage. This rotation may help to optimize exhaust gas flow through the passage in order to reduce frictional loss and backflow into the cylinder. In one embodiment the optimal angle $\alpha$ is $\geq 10°$.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to I-3, I-4, I-6, V-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising a cylinder head and a cylinder:

the cylinder having an outlet opening, the outlet opening being connected to an exhaust passage;

the exhaust passage having a cross section which changes in a flow direction; and a bend in the exhaust passage having a cross section with a delimiting edge forming two limbs extending from a central portion comprising a depression.

2. The engine of claim 1, wherein the cross section of the bend has a rounded corner.

3. The engine of claim 2, wherein a portion of the exhaust passage includes a curvature.

4. The engine of claim 3, wherein a portion of the cross section of the bend includes an undulating shape.

5. The engine of claim 4, wherein the two limbs which are connected to one another by an interposed central limb.

6. The engine of claim 5, wherein a third limb branches off from the central limb and the third limb is arranged between the two limbs.

7. The engine of claim 6, wherein the third limb is shorter than each of the two lateral limbs.

8. The engine of claim 5, wherein an edge of the cross section includes the depression.

9. The engine of claim 3, wherein the cross section of the bend is arranged within the cylinder head.

10. The engine of claim 9, having at least two exhaust passages, wherein the at least two exhaust passages merge to form an overall exhaust passage within the cylinder head.

11. The engine of claim 3, wherein an exhaust-gas turbocharger is provided which comprises at least a turbine connected to the exhaust passage.

12. The engine of claim 3, wherein a shape of the cross section of the bend rotates an angle with respect to a longitudinal axis of the exhaust passage.

13. An engine comprising:

a cylinder;

a cylinder head including an exhaust passage;

the exhaust passage having a bend that changes direction relative to a longitudinal axis of a piston and an axis perpendicular to the longitudinal axis; and the bend having a cross sectional shape including a depression which extends radially inward creating two limbs that extend radially outward.

14. The engine of claim 13, including further cylinders, cylinder heads, and exhaust passages.

15. The engine of claim 14, wherein the exhaust passages' cross sectional shape rotates relative to the longitudinal axis of the exhaust passage.

16. The engine of claim 15, wherein the exhaust passage has multiple bends.

17. The engine of claim 13, wherein the cross section has a trapezoidal shape outline at a location.

18. An engine comprising:

a cylinder and a cylinder head;

the cylinder head including integrated exhaust passages and each exhaust passage merging with an exhaust passage of another cylinder within the cylinder head;

each exhaust passage changing direction relative to a longitudinal axis of a piston, an axis perpendicular to the longitudinal axis and extending through a cylinder bank, and an axis perpendicular to the other two axes; and each exhaust passage having an asymmetrical cross section which changes continuously as it extends for greater than half a length of the exhaust passage and the changes occur via one or more depressions.

19. The engine of claim 18, wherein multiple exhaust passages merge to form a lesser number of passages.

20. The engine of claim 19, wherein the cross section rotates an angle relative to the longitudinal axis of the exhaust passage as the exhaust passage extends away from the cylinder.

* * * * *